US005235958A

United States Patent [19]

Laffin

[11] Patent Number: 5,235,958

[45] Date of Patent: Aug. 17, 1993

[54] RETRACTABLE ARROW HOLDER

[76] Inventor: Gerald A. Laffin, E 17497 Hwy. 52, Aniwa, Wis. 54408

[21] Appl. No.: 904,338

[22] Filed: Jun. 23, 1992

[51] Int. Cl.[5] ..... F41B 5/22; F41B 5/14

[52] U.S. Cl. ..... 124/44.5; 124/24.1; 124/88

[58] Field of Search ..... 124/23.1, 24.1, 25.6, 124/44.5, 86, 88

[56] References Cited

U.S. PATENT DOCUMENTS

| | | | |
|---|---|---|---|
| 2,483,928 | 10/1949 | Ott . | |
| 2,691,974 | 10/1954 | Nelson | 124/44.5 |
| 2,743,716 | 5/1956 | Wendt . | |
| 3,059,631 | 4/1966 | Yasho . | |
| 3,244,161 | 4/1966 | Jenson . | |
| 3,406,676 | 10/1968 | Dye . | |
| 4,038,960 | 8/1977 | Ludwig . | |
| 4,318,390 | 3/1982 | Trotter . | |
| 4,343,286 | 8/1982 | Thacker . | |
| 4,344,409 | 8/1982 | Barner . | |
| 4,577,612 | 3/1986 | Zell | 124/44.5 |
| 4,662,346 | 5/1987 | Laffin | 124/44.5 |
| 4,685,439 | 8/1987 | Cosentino, Jr. | 124/44.5 |
| 4,748,963 | 6/1988 | Troncoso et al. | 124/24.1 |
| 4,809,669 | 3/1989 | Saunders | 124/24.1 |
| 4,809,670 | 3/1989 | Simo | 124/44.5 |
| 4,865,007 | 9/1989 | Saunders | 124/44.5 |
| 4,890,596 | 1/1990 | Barlow | 124/44.5 |
| 4,919,115 | 4/1990 | Miller | 124/24.1 |
| 4,949,699 | 8/1990 | Gerber | 124/44.5 |
| 5,009,215 | 4/1991 | Ludwig | 124/44.5 |
| 5,022,378 | 6/1991 | Rhodehouse et al. | 124/44.5 |
| 5,103,797 | 4/1992 | Newbold | 124/44.5 |

*Primary Examiner*—Randolph A. Reese
*Assistant Examiner*—John Ricci
*Attorney, Agent, or Firm*—Lathrop & Clark

[57] ABSTRACT

A mounting plate affixes to the vertical riser of a conventional bow. A two-way compression spring extends frontwardly from the mounting plate. A hook member with a downwardly protruding hook on one end and a protruding nub on the other end is rotatably and extensibly connected to the mounting plate by the spring. A catch protrudes frontwardly from the plate and has a rearwardly inclined upper surface. In an arrow holding position, the nub is engaged with the catch and the hook holds the shaft of the arrow. When the arrow head is drawn back, the hook member is pivoted rearwardly to release the nub from the catch allowing the hook member to return to a retracted position. An elastic cylinder may be substituted for the spring.

9 Claims, 5 Drawing Sheets

RETRACTABLE ARROW HOLDER

The present invention is directed to archery equipment in general and to devices for holding an arrow on a bow in particular.

BACKGROUND OF THE INVENTION

Archers in general, and bow hunters in particular, are often required to shoot an arrow in a short period of time. Bow hunters may have only a matter of seconds to target and shoot a fleeing prey. Because the steps of extracting an arrow from a quiver, nocking it on the bow string, and positioning the arrow on an arrow rest consume an unacceptable time period, bow hunters typically hunt with an arrow nocked to the bow string and undrawn. Conventional arrow rests support the shaft of the arrow from below, but do not prevent the nocked arrow from rolling or tipping off the rest. For short periods of time the arrow may be held in place by the archer's bow hand index finger looped around the arrow. However, as hunters may often go hours or days before discharging an arrow, the hand held position is inadequate for lengthy hunts.

Numerous arrow holding devices have been developed to address the bow hunter's need. Some of these devices require activation of a trigger to release the arrow from its held position. Others employ tethers connected to the bow string to retract the arrow holder or utilize mechanisms which may be cumbersome to retract or engage.

For accuracy it is essential that the arrow holder not interfere with the discharge of the arrow. Furthermore, in hunting applications, the release of the holder should be substantially silent to avoid startling the game.

What is needed is an arrow holder which is quiet, reliable, which does not interfere with loading or discharge of the arrow, and which is substantially automatic in operation.

SUMMARY OF THE INVENTION

The arrow holder of the present invention has a frontwardly facing mounting plate which is adapted for attachment to the vertical riser of a conventional bow. The holder will typically be used in conjunction with a conventional arrow rest which positions the arrow shaft to one side of the riser. A resilient member extends frontwardly from the mounting plate and is elastically extensible and rotatable. In a preferred embodiment the resilient member is a two-way compression spring. A hook member has a downwardly protruding hook on one end and a protruding nub on the other end. The hook member is attached to the compression spring and is thereby rotatably and extensibly connected to the mounting plate at a point intermediate along the hook member. A catch protrudes frontwardly from the mounting plate and has a rearwardly inclined upper surface. When the hook member is in a position engaged with an arrow, the nub engages with the catch and the hook holds the shaft of an arrow. Drawing of the bow string displaces a nocked arrow such that the arrow broadhead engages against the hook to displace the hook end rearwardly and to pivot the nub frontwardly about the spring to disengage the nub from the catch and allow the hook end to pivot upwardly into a retracted position which does not obstruct the path of the arrow.

The resilient member may also be an elastic cylinder.

It is an object of the present invention to provide an arrow holder which is lightweight.

It is also an object of the present invention to provide an arrow holder of mechanically simple construction.

It is another object of the present invention to provide an arrow holder which is reliable in operation.

It is a further objection of the present invention to provide an arrow holder which may be manufactured to low tolerances.

It is yet another object of the present invention to provide an arrow holder which does not interfere with the loading or shooting of arrows.

It is a still further object of the present invention to provide an arrow holder which may be conveniently mounted to a wide variety of conventional bows.

Further objects, features, and advantages of the invention will be apparent from the following detailed description when taken in conjunction with the accompanying drawings.

DESCRIPTION OF THE PREFERRED EMBODIMENT

Figure 2:
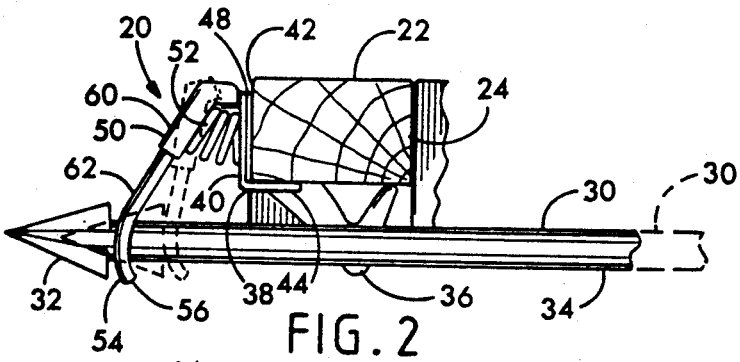
FIG. 2 is a top plan view of the arrow holder of FIG. 1 taken along section line 2—2, the arrow holder being shown in an engaged position, with a released position shown in phantom.
Figure 1A:
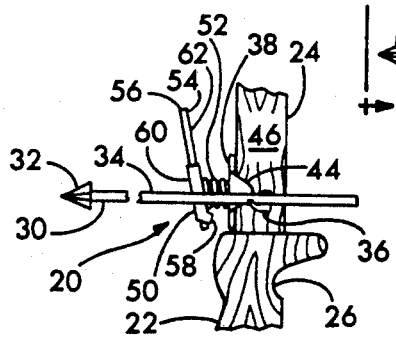
FIG. 1A is a side elevational view of the arrow holder of FIG. 1 in a retracted position.
Figure 1:
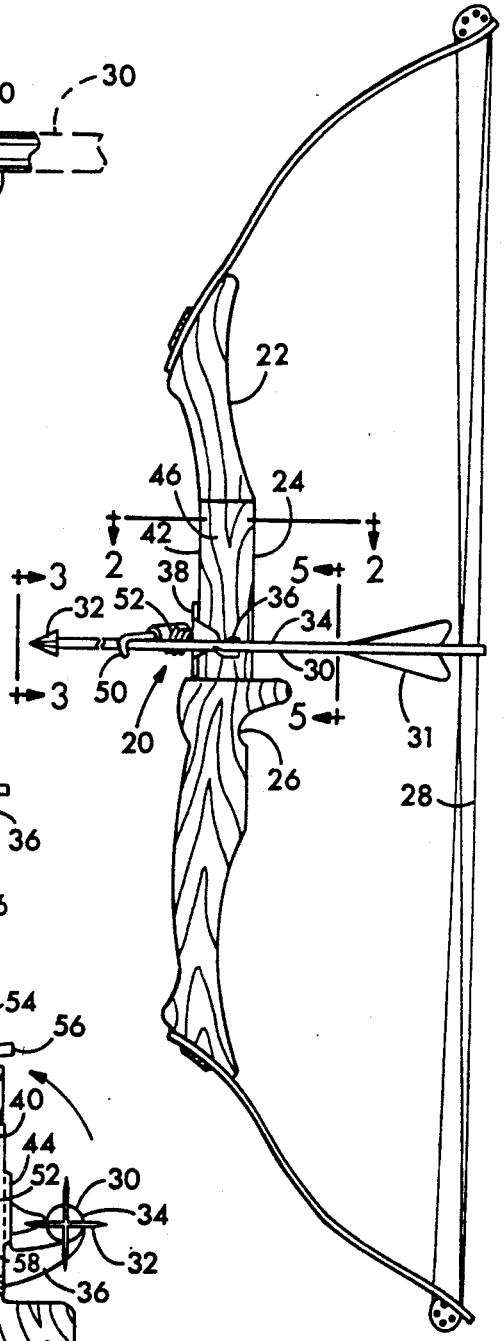
FIG. 1 is a side elevational view of the arrow holder of the present invention mounted to a right-handed bow having an arrow rest and an arrow loaded thereon.
Figure 3:
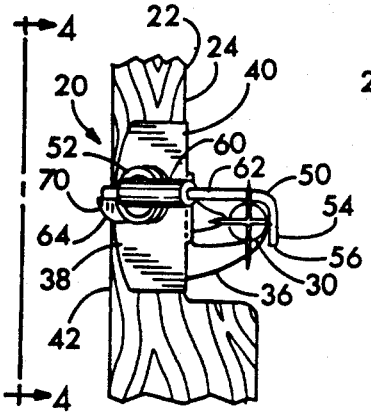
FIG. 3 is a front elevational view of the arrow holder of FIG. 1 in an engaged position.
Figure 4:
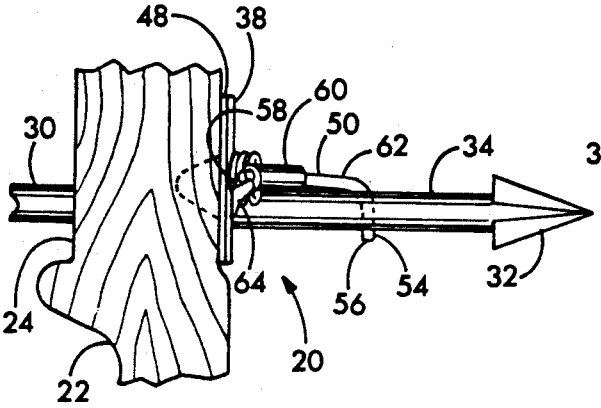
FIG. 4 is a side elevational view of the arrow holder of FIG. 3 in an engaged position.
Figure 5:
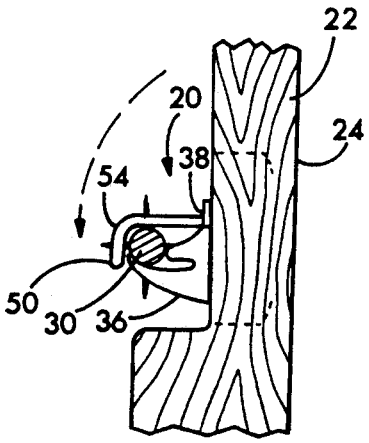
FIG. 5 is a rear elevational view of the arrow holder of FIG. 1 in an engaged position.
Figure 5A:
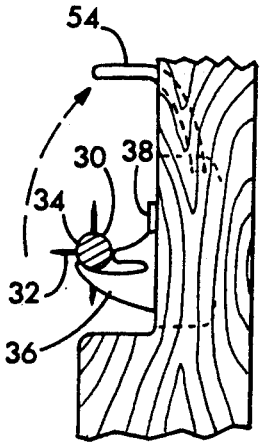
FIG. 5A is a rear elevational view of the arrow holder of FIG. 5 in a retracted position.

Referring more particularly to FIGS. 1–10A, wherein like numbers refer to similar parts, an arrow holder 20 is shown in FIG. 1 affixed to a conventional compound bow 22. The bow 22 is exemplary of bows commonly used in target practice and hunting in that it has a narrow vertical riser 24 which extends above a hand grip 26. The bow has a bow string 28 to which an arrow 30 is nocked prior to discharging the arrow from the bow. The arrow 30 illustrated is a conventional broadhead arrow having three feathers 31 and a head 32 having sharpened blades which extend radially outwardly from the arrow shaft 34. The arrow is supported by a conventional arrow rest 36 which, as shown in FIGS. 2 and 5, extends sidewardly from the riser 24 beneath the arrow 30. Although an exemplary arrow rest 36 has been illustrated, it should be noted that the arrow holder 20 may be used in conjunction with any number of arrow rests which provide a similar function.

Figure 6:
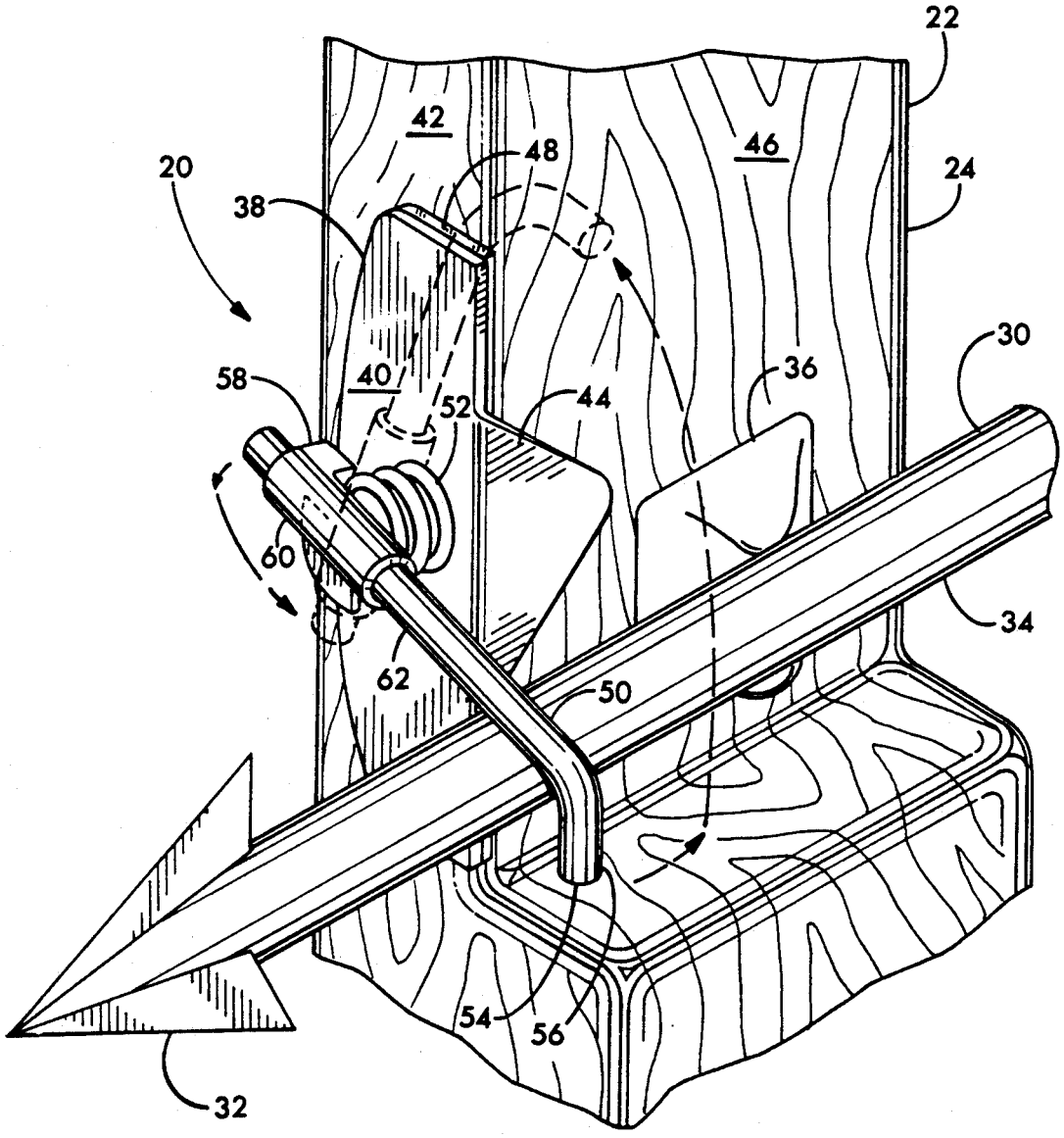
FIG. 6 is a front isometric view of the arrow holder of FIG. 1 in an engaged position, with a retracted position shown in phantom.

The arrow holder 20, as shown in FIG. 6, is a mechanically simple device which may be mounted as an accessory to any conventional bow. The arrow holder 20 has a mounting plate 38 formed of stiff sheet material, preferably metal, which has a front plate segment 40 which is adapted for mounting to the front 42 of the bow riser 24. A smaller alignment tab 44 extends rearwardly from the mounting plate front segment 40 and is adapted to lie alongside the vertical side 46 of the bow riser 24.

The mounting plate 38 may be affixed to the bow 22 by tacks or screws, but is preferably affixed by means of a double-sided adhesive foam tape 48.

The arrow holder 20 has a hook member 50 which is extensibly and rotatably connected to the mounting plate 38 by a resilient member which in a preferred embodiment is a two-way compression spring 52.

The spring 52 is a looped metal spring which in its relaxed position extends frontwardly horizontally from the mounting plate 38 and the bow 22. The spring 52 may be extended or expanded frontwardly and it may be rotated in a clockwise direction when viewed from the bow front. The extended or rotated spring 52 will exert a restoring force tending to return the spring to its unextended, unrotated position.

The hook member 50 has a downwardly protruding hook 54 at the hook end 56 and a downwardly and rearwardly protruding nub 58 which protrudes from the hook member 50 at the end opposite the hook end 56. In a preferred embodiment the nub may be formed on a metal collar 60 which grips the plastic shaft 62 from which the hook 54 extends. Alternatively, the entire hook member may be fabricated of a suitable plastic material. One end of the spring 52 is fixed to the mounting plate 38 and the other end is fixed to the hook member collar 60. The spring 52 is connected to the hook member 50 at a point intermediate between the hook end 56 and the nub 58, and closer to the nub than to the hook.

Figure 4A:
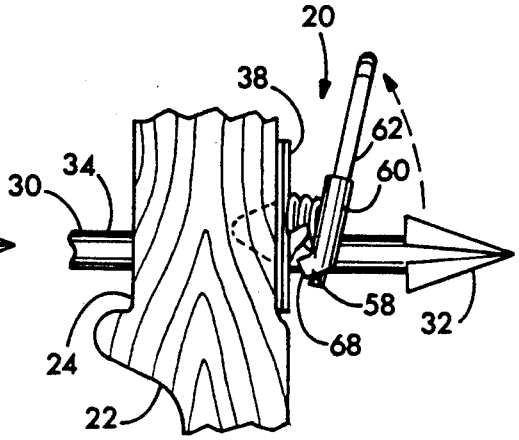
FIG. 4A is a side elevational view of the arrow holder of FIG. 4 in a retracted position.

As best shown in FIGS. 4 and 4A, a catch 64 extends frontwardly from the front plate segment 40 of the mounting plate 38 on the side of the mounting plate opposite the riser mounted arrow rest 36. The catch 64 has an upper surface 66, shown in FIG. 2A, which is inclined rearwardly towards the bow riser 24. The nub 58 has a downwardly protruding portion 68, shown in FIG. 4A, which is engagable with the catch upper surface 66. The catch may be metal but is preferably molded plastic.

The hook member 50 has two at rest positions. As shown in FIG. 3, in the engaged position, the hook 54 of the hook member 50 extends over the shaft 34 of the arrow 30 and downwardly. The hook member 50 remains in the engaged position so long as the nub 58 is captured within the catch 64. Due to the resiliency of the spring 52, the hook member exerts a light clamping force on the shaft 34 of the arrow 30. This resiliency also allows the hook member to accommodate arrows with shafts of different diameter.

Figure 3A:
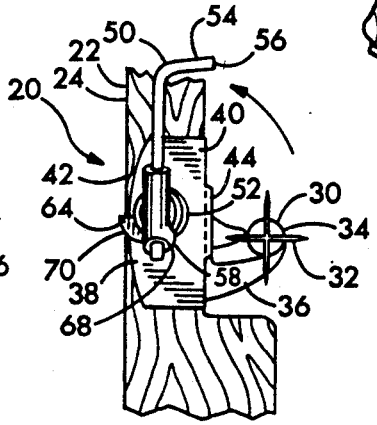
FIG. 3A is a front elevational view of the arrow holder of FIG. 3 in a retracted position.

When the nub 58 is displaced from the catch 64 the hook member 50 is automatically returned to a retracted position, shown in FIG. 3A. In the retracted position the hook member 50 is generally upright and does not obstruct the path of the arrow 30.

Figure 2A:
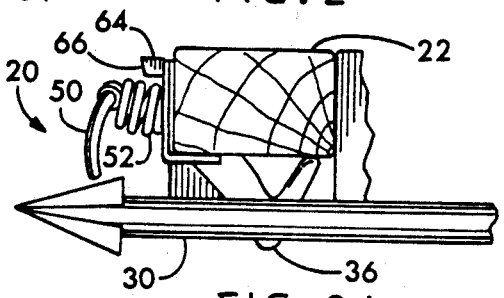
FIG. 2A is a top plan view of the arrow holder of FIG. 2 in a retracted position.

The operation of the arrow holder 20 is best shown in FIGS. 2, 2A and 6. A bow hunter, whether on foot, or hidden in a blind, will wish to position an arrow 30 in the bow 22 to be ready to discharge the arrow on a moment's notice. The arrow is loaded with the hook member 50 in its retracted position as shown in FIGS. 1A, 2A, 3A, 4A, and 5A. In this retracted position, the arrow holder 20 does not interfere with conventional loading of the arrow into position.

In the retracted position, the spring 52 is in its relaxed condition. As shown in FIG. 4A, the retracted hook member 50 is inclined frontwardly somewhat. Once the arrow has been nocked to the bow string 28 and rested on the arrow rest 36, the archer may reach up with the index finger of the bow hand to pivot the hook member 50 about the spring 52 to bring the hook 54 over the shaft 34 of the arrow 30. As best shown in FIGS. 3 and 3A, as the hook end 56 of the hook member 50 is pivoted downwardly, the nub 58 is caused to pivot upwardly. As the nub downwardly protruding portion 68 travels over the frontwardly facing surface 70 of the catch 64, which is inclined upwardly and frontwardly, the spring 52 is extended and the nub 58 moves frontwardly. When the nub downwardly protruding portion 68 reaches the upper surface 66 of the catch 64 it will seat therein and hold the hook member 50 in its generally horizontal engaged position until released. The spring 52 will tend to retain the nub 58 in engagement with the catch 64.

As best shown in FIG. 2, the release of the hook member 50 from its arrow holding engaged position is automatic. To shoot an arrow from the bow 22, it is necessary for the archer to draw the bow string 28 and displace the nocked arrow rearwardly until the string has reached its full draw position. As the arrow shaft 34 is drawn rearwardly, the arrow head 32 is displaced rearwardly to engage against the hook 54 of the hook member 50. The radially extending head 32 pulls the hook member 50 rearwardly with it, causing the hook member 50 to pivot about a vertical axis about the spring 52. The rearward pivoting of the hook end 56 results in the frontward pivoting of the nub 58 and the release of the nub 58 from the catch 64. As shown diagramatically by the arrows in FIG. 6, the released hook member 50 is returned by the spring 52 to the retracted position. The archer is now free to shoot the drawn arrow 30 without interference from the arrow holder 20.

The simple retraction mechanism provides for repeatable and reliable performance from the arrow holder 20 in a low cost archery accessory. As none of the positions of the parts need to be accurate to high tolerances, the arrow holder 20 may be produced at low cost.

Figure 7:
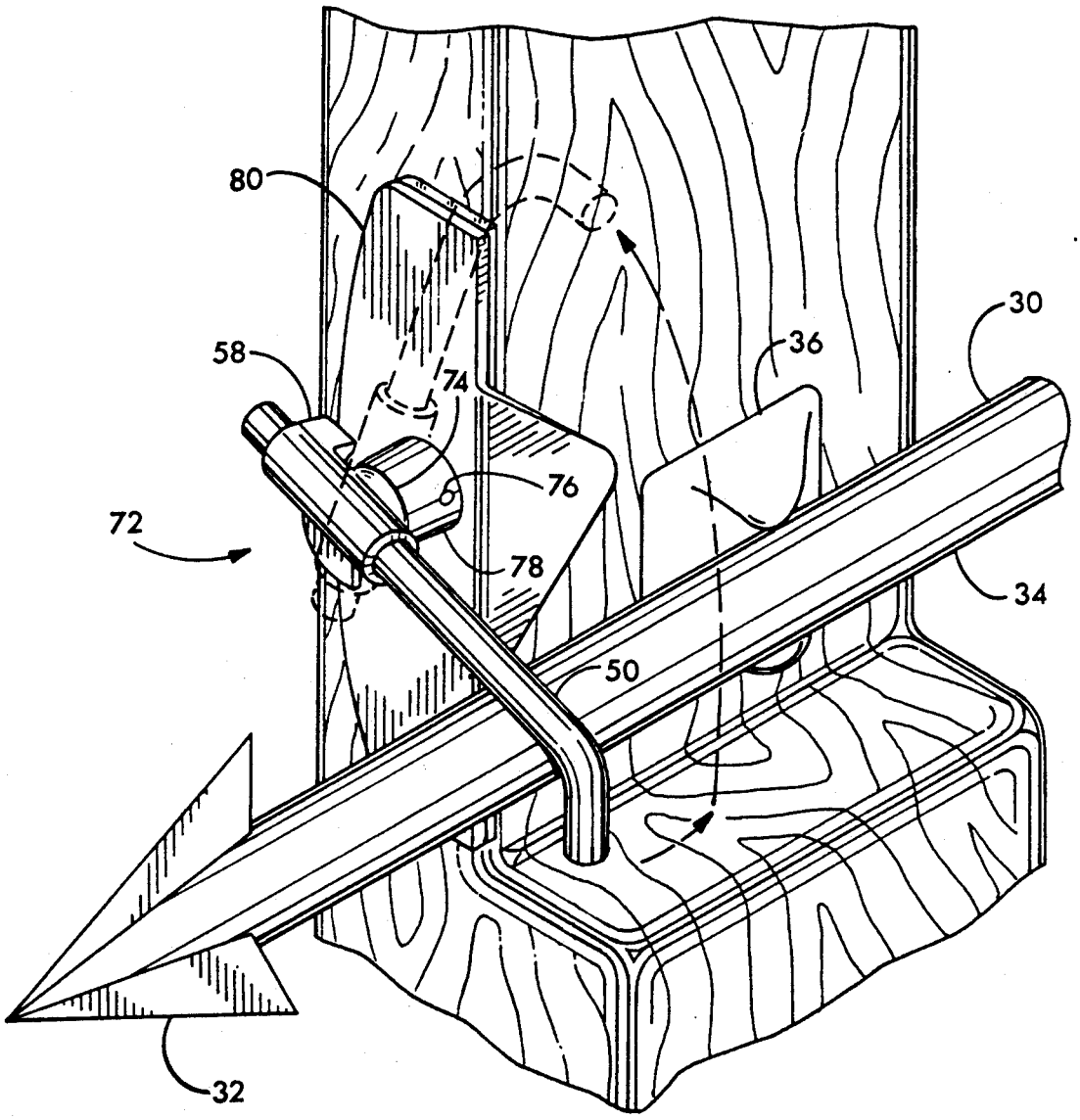
FIG. 7 is a front isometric view of an alternative embodiment of the arrow holder of the present invention.
Figure 8:
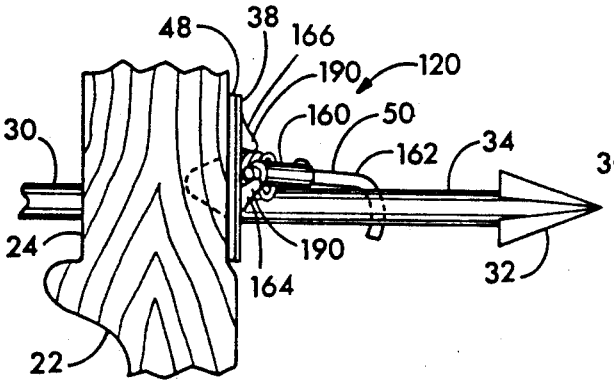
FIG. 8 is a side elevational view of an alternative embodiment of the arrow holder of the present invention suited for mounting to a left-handed or right-handed bow.
Figure 8A:
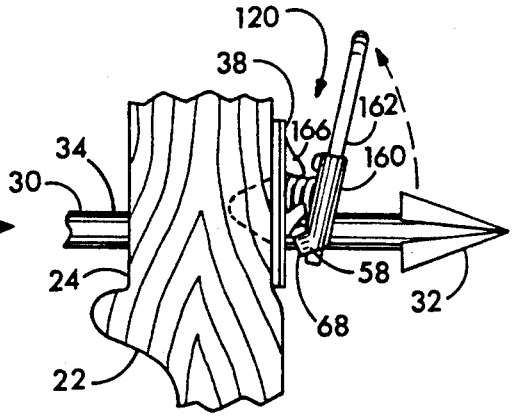
FIG. 8A is a side elevational view of the arrow holder of FIG. 8 in a retracted position.

An alternative embodiment arrow holder 72 is shown in FIG. 7. In the arrow holder 72, the resilient member is a rubber or flexible polymer cylinder 74 which is pinned by a pin 76 within a cylindrical collar 78 which is fixed to a mounting plate 80. The hook member 50 and catch are identical to those of the arrow holder 20.

It should be noted that the arrow holder 20 of this application may be fabricated entirely of metal or plastic as needs require. Furthermore, the arrow holder may be used with any conventional bow.

Figure 9:
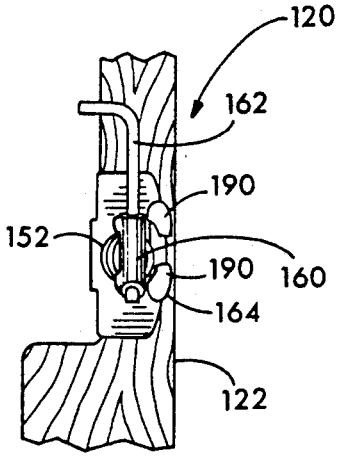
FIG. 9 is a front elevational view of the arrow holder of FIG. 8A mounted to a left-handed bow.
Figure 10:
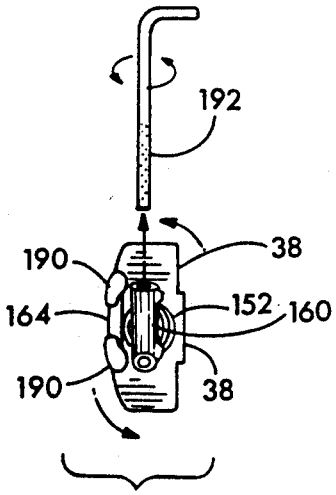
FIG. 10 is an exploded front elevational view of the arrow holder of FIG. 8, with directional arrows indicating the steps to convert a right-handed bow arrow holder to a left-handed bow arrow holder.
Figure 10A:
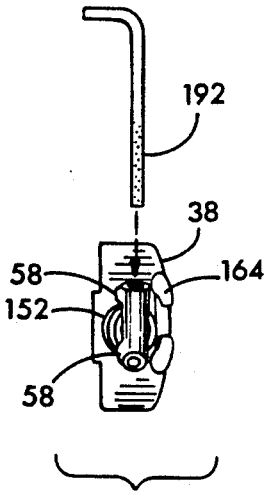
FIG. 10A is an exploded front elevational view of the arrow holder of FIG. 10 re-oriented to be mounted on a left-handed bow.

An alternative preferred embodiment arrow holder 120 is illustrated in FIGS. 8–10A. The arrow holder 120 is adapted for simple modification to suit either a right-handed bow 22 or a left-handed bow 122, as shown in FIG. 9. The arrow holder 120 has a double catch 164 which has two identical catch members 190. Each catch member 190 is identical to the catch 64 of the arrow holder 20. One catch member 190 is spaced above the other such that a rotation of the arrow holder 120 of 180°, as shown in FIGS. 10 and 10A, will bring the second catch member 190 into a position previously occupied by the first catch member. The arrow holder 120 has a collar 160 with two nubs 58. The nubs are positioned at opposite ends of the collar 160 with both nubs on the side of the collar opposite the catch 164. As best shown in FIG. 10, the arrow holder 120 has an insertable shaft 162. The shaft 162 is preferably formed of fiberglass or other heat resistant plastic.

As illustrated in FIGS. 10 and 10A, a purchaser of an arrow holder 120 may quickly configure that arrow holder for his preference in mounting to a left-handed or right-handed bow. The insertable shaft 162 is preferably precoated with a hot melt adhesive 192. For purposes of illustration, the reconfiguration of a right-handed arrow holder to a left-handed arrow holder is shown in FIGS. 10 and 10A. The shaft 162 is removed from the collar 160 and rotated 180°. The mounting plate 38 is rotated 180° also. The shaft 162 is then inserted into the collar 160. The collar shaft assembly is then heated with a match or flame to fix the shaft in position. Prior to heating, if necessary, the position of the shaft may be adjusted to suit a particular bow. The arrow holder 120 operates in a manner similar to the arrow holder 20. With one or the other of the catch members 190 being employed depending upon the orientation of the holder 120. It is important to note that the spring 152 will exert a rotational restoring force in response to a clockwise or counter-clockwise rotation.

It is understood that the invention is not confined to the particular construction and arrangement of parts herein illustrated and described, but embraces such modified forms thereof as come within the scope of the following claims.

I claim:

1. An arrow holder for mounting to a bow, the holder comprising:

a) a mounting plate adapted for attachment to a vertical riser of the bow;

b) a compression spring connected to the mounting plate to extend frontwardly from the bow;

c) a stiff hook member having an angled hook, and the hook member is attached to the spring and rotatably connected to the mounting plate by the spring, wherein the hook member is rotatable from an engaged position in which the hook overlies the shaft of an arrow loaded in the bow, and a retracted position in which the hook member does not obstruct the path of the arrow;

d) a catch which protrudes frontwardly from the mounting plate; and e) a nub connected to the hook member, such that the nub engages with the catch when the hook member is in the engaged position, and the spring advances the hook member to the retracted position when the nub is disengaged from the catch.

2. The arrow holder of claim 1 wherein the hook member comprises a cylindrical hollow collar with an insertable shaft member inserted therein, the hook being formed as part of the shaft, and the catch comprises two opposed catch members, and the collar has two identical nubs, adapted to engage against one or the other of the catch members, depending upon the orientation of the shaft within the collar, such that the arrow holder may be configured for mounting on a right-handed or left-handed bow by a rotation of the arrow holder and proper positioning of the shaft member.

3. The arrow holder of claim 1 further comprising an alignment tab which extends rearwardly from the mounting plate, the alignment tab being adapted to lie against a side of a bow riser to position the arrow holder horizontally with respect to a shaft of an arrow

4. The arrow holder of claim 1 wherein the catch has an upper surface which is inclined rearwardly towards the bow riser and the nub has a downwardly protruding portion which engages the catch upper surface, and the hook member has a hook end which is adapted to engage the shaft of an arrow and a nub end, to which the nub is connected, and wherein the rearward displacement of the hook end causes the nub downwardly protruding portion to travel over the catch upper surface to disengage the nub from the catch.

5. An arrow holder for holding an arrow loaded within a bow, the arrow holder comprising:

a) a frontwardly facing mounting plate adapted for attachment to a vertical riser of the bow, wherein an arrow shaft is positioned to the side of the riser;

b) a resilient member connected to the mounting plate and extending frontwardly, the resilient member being elastically extensible and rotatable;

c) a hook member having a downwardly protruding hook on one end and a protruding nub on the other end, the hook member being rotatably and extensibly connected to the mounting plate by the resilient member at a point along the hook member intermediate between the hook and the nub; and d) a catch which protrudes from the mounting plate, such that the nub engages with the catch and is held by the catch in a hook member engaged position in which the hook is adapted to overlie and hold the shaft of a loaded arrow, and the nub is disengaged from the catch when the hook is displaced rearwardly by the rearward displacement of the arrow, wherein the disengaged hook end pivots upwardly into a retracted position which does not obstruct the path of the arrow.

6. The arrow holder of claim 5 wherein the hook member comprises a cylindrical hollow collar with an insertable shaft member inserted therein, the hook being formed as part of the shaft, and the catch comprises two opposed catch members, and the collar has two identical nubs, adapted to engage against one or the other of the catch members, depending upon the orientation of the shaft within the collar, such that the arrow holder may be configured for mounting on a right-handed or left-handed bow by a rotation of the arrow holder and proper positioning of the shaft member.

7. The arrow holder of claim 5 wherein the resilient member comprises a compression spring.

8. The arrow holder of claim 5 wherein the resilient member comprises an elastic cylinder pinned to the mounting plate.

9. The arrow holder of claim 5 wherein the catch has an upper surface which is inclined rearwardly towards the bow riser and the nub has a downwardly protruding portion which engages the catch upper surface, and wherein rearward displacement of the hook end causes the nub downwardly protruding portion to travel over the catch upper surface to disengage the nub from the catch.

* * * * *